United States Patent [19]

Short

[11] 4,155,319

[45] May 22, 1979

[54] LOOPER APPARATUS FOR FORMING CUT PILE AND LOOP PILE IN THE SAME ROW OF STITCHING

[75] Inventor: Hoyt E. Short, Chattanooga, Tenn.

[73] Assignee: Tuftco Corporation, Chattanooga, Tenn.

[21] Appl. No.: 913,673

[22] Filed: Jun. 8, 1978

[51] Int. Cl.[2] ..... D05C 15/00

[52] U.S. Cl. ..... 112/79 R

[58] Field of Search ..... 112/79 A, 79 R

[56] References Cited

U.S. PATENT DOCUMENTS

| | | | |
|---|---|---|---|
| 3,084,645 | 4/1963 | Card | 112/79 R |
| 3,595,184 | 7/1971 | Watkins | 112/79 R |
| 4,048,930 | 9/1977 | Card | 112/79 R |

*Primary Examiner*—Ronald Feldbaum

*Attorney, Agent, or Firm*—Harrington A. Lackey

[57] ABSTRACT

A looper apparatus for a multiple-needle tufting machine including transversely spaced loopers or hooks having spring clips or looper clips attached thereto and cooperating with knives to form cut pile and loop pile in the same row of stitching, in cooperation with a controlled yarn feed, in which the spring clips are mounted on the cutting side of each hook and extend beneath the hook to terminate in the clamping portion of the clip on the needle side of the hook, without occupying the cutting zone of the corresponding knife.

8 Claims, 4 Drawing Figures

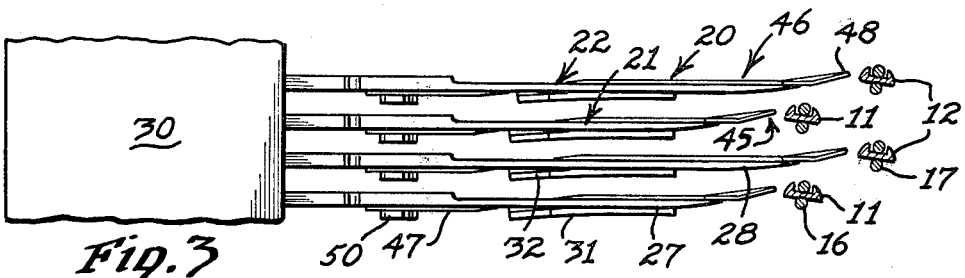
Fig. 3
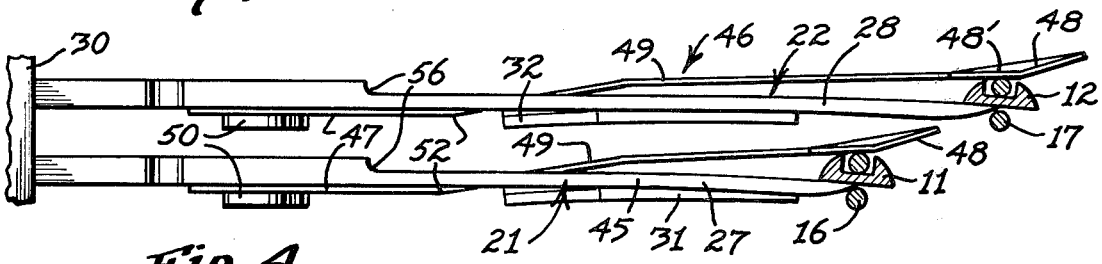
Fig. 4
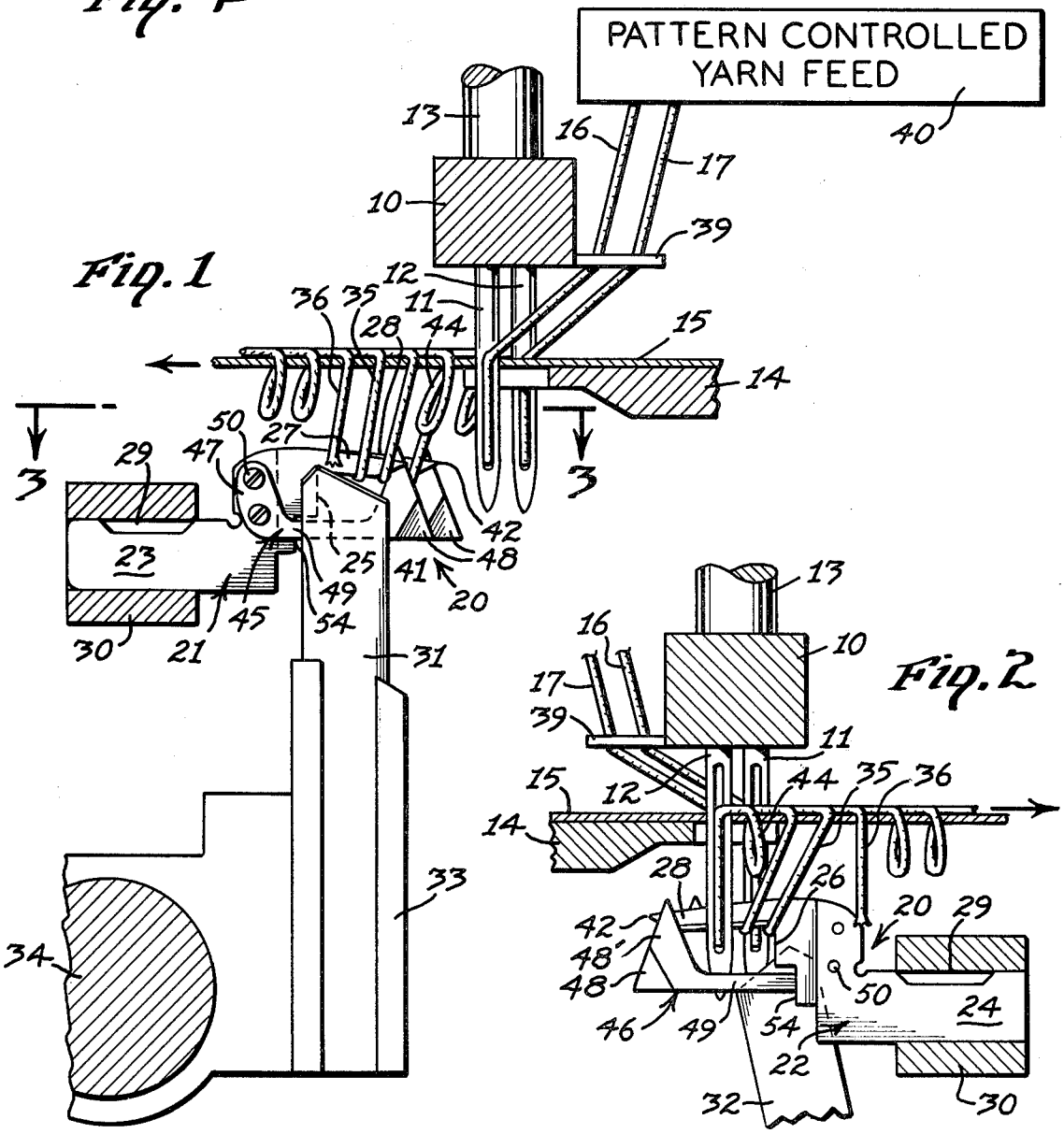
Fig. 1
Fig. 2

LOOPER APPARATUS FOR FORMING CUT PILE AND LOOP PILE IN THE SAME ROW OF STITCHING

BACKGROUND OF THE INVENTION

This invention relates to tufting machines, and more particularly to a looper apparatus for a multiple-needle tufting machine adapted to form loop pile and cut pile in the same row of stitching.

In multiple-needle tufting machines having conventional gauges of ¼" or greater, loop pile and cut pile have been formed in the same row of stitching by looper apparatus, such as that disclosed in the Card U.S. Pat. No. 3,084,645, issued Apr. 9, 1963.

In the prior Card patent, the looper apparatus includes a hook having a smooth, pointed bill extending in the direction opposite from the direction of the fabric feed. A looper clip is fixed to the needle side of each hook and extends along, but is laterally spaced from and below the lower or bottom edge of, the hook, and then terminates in a free end or clamp portion biased into engagement against the free or pointed end portion of the hook. In the prior Card patent, the speed of the yarn fed to the needles is selectively controlled by a pattern control mechanism. Normal lengths of yarn are fed to the needles for making a normal-length loop pile which is secured and held upon the bill of the looper apparatus and subsequently cut by a knife to form a normal-length cut-pile tuft. On the other hand, when the pattern control mechanism starves the yarn feed, tension is applied to the yarn caught on the hook. As the hook retracts, the yarn forces the clamping end of the looper clip way from the bill so that the loop is released and shortened, but is not cut, to thereby form a shorter uncut pile loop.

However, since the trend in the tufting industry is to employ more narrow needle gauges for forming tufted fabrics, such as carpet, the hooks, looper clips and knives become more crowded, as the gauge of the needles is reduced. Where the gauge is reduced to 3/16 of an inch, the knives must be set with more care, thereby requiring more time, so that the looper clips will not interfere with the knives.

When the gauge is reduced to 5/32 of an inch, the setting of knives becomes extremely critical. When the gauge is reduced to ⅛ of an inch, production of tufting fabrics including loop pile and cut pile in the same row of stitching formed by adjacent hooks, knives and looper clips, becomes practically impossible.

Where the gauge is so narrow, the looper clip of one looper interferes with the knife of the adjacent looper.

SUMMARY OF THE INVENTION

It is therefore an object of this invention to provide a looper apparatus for a narrow-gauge, multiple-needle tufting machine for forming loop pile and cut pile in the same row of stitching, which avoids the above-enumerated problems.

In the looper apparatus for a narrow gauge loop/cut pile tufting machine, made in accordance with this invention, the same type hooks and knives are used as were employed in the conventional tufting machines, such as those disclosed in the prior Card U.S. Pat. No. 3,084,645.

However, each looper clip attached to a hook has been substantially modified to avoid striking or otherwise interfering with the knife cooperating with the adjacent loop hook.

The looper clip made in accordance with this invention still includes a basic mounting portion, which is fixed to the cutting side of the shank of the hook, and a free end clamping portion biased into engagement with the needle side of the free end or pointed end portion of the hook bill. However, the main body portion of the looper clip connecting the mounting portion to the clamping portion extends across and beneath the major portion of the bill. The connecting portion of the looper clip is entirely outside the cutting zone of the hook, and does not occupy any portion of the path of the corresponding knife cooperating with the hook, during the entire operation of the looper apparatus.

Each looper clip made in accordance with this invention is preferably made from a unitary spring steel material and is generally arch-shaped, concave upward. The main body portion connecting the mounting portion and the clamping portion is spaced below the lower cutting edge of the bill, and is substantially contained between the planes of the cutting side and the needle side of the corresponding hook, so that the lateral projection of any portion of the loop clip beyond the sides of the hook is minimal.

BRIEF DESCRIPTION OF THE DRAWINGS

FIG. 1 is a fragmentary, sectional elevation of a portion of a narrow-gauge, staggered-needle tufting machine incorporating this invention, disclosing the hooks and knives in cutting positions;

FIG. 2 is an opposite side, fragmentary elevational view similar to FIG. 1, disclosing the hooks cooperating with the needles in non-cutting position;

FIG. 3 is an enlarged, fragmentary section taken along the line 3—3 of FIG. 1;

FIG. 4 is a further enlarged section, similar to FIG. 3, but disclosing only two of the hooks and looper clips cooperating with the needles for catching or engaging loops.

DESCRIPTION OF THE PREFERRED EMBODIMENT

Referring now to the drawings in more detail, FIGS. 1 and 2 disclose a typical needle bar 10 supporting a plurality of needles 11 in a first or rear transverse row and a plurality of needles 12 in a second or front transverse row spaced longitudinally forward of the first row of needles 11. The needle bar 10 is adapted to reciprocably move between the lower position disclosed in FIG. 2 penetrating the base fabric 15, and an upper position, not shown, above the base fabric 15, by a push rod 13, driven by conventional means, not shown.

As best disclosed in FIG. 3, the needles 11 in the first row and the needles 12 in the second row are alternately staggered transversely of the tufting machine, and are preferably equidistant from each other, as well as being equidistantly staggered.

Supported upon a needle plate 14 for movement longitudinally from front to rear in a feeding direction through the tufting machine is a base fabric 15. Each needle 11 carries a yarn 16 and each needle 12 carries a yarn 17 through the base fabric 15 upon each stroke of the needle bar 10.

The looper apparatus made in accordance with this invention may include staggered hooks. However, the looper apparatus 20 disclosed in the drawings includes the transversely aligned hooks 21 and 22 having shanks 23 and 24, and transversely aligned throats 25 and 26. However, bills 27 and 28 of the hooks 21 and 22 are of different lengths so that the free ends 41 and 42 of the bills 27 and 28 are staggered correspondingly with the needles 11 and 12. Each shank 23 and 24 is adapted to be received in a respective slot 29 in the reciprocal hook bar 30.

Furthermore, each hook 21 and 22 is adapted to cooperate with a corresponding knife 31 and 32, respectively, all of which knives are also transversely aligned.

The looper apparatus 20 thus far described is substantially the same as that disclosed in the Card U.S. Pat. No. 4,003,321, issued Jan. 18, 1977.

Each of the knives 31 and 32 are identical and mounted in transverse alignment in corresponding knife holders 33 fixed to the reciprocal knife shaft 34 adapted to be rocked or reciprocated in a conventional manner. Each knife 31 and 32 is adapted to cooperate with its corresponding hook 21 and 22 in order to cut loops 35 to form long cut pile tufts 36.

The yarns 16 and 17 are fed to the respective needles 11 and 12 through yarn guide 39, fixed to the needle bar 10, from a pattern control yarn feed mechanism 40, of any conventional type, such as that disclosed in the prior Card U.S. Pat. No. 3,084,645.

The pattern control yarn feed apparatus 40 is adapted to selectively reduce the speed of the yarns 16 and 17 fed to the corresponding needles 11 or 12 in order to starve the yarn feed, and create additional tension in the corresponding yarn. Thus, after a loop 35 is formed upon a bill, such as bill 27 in FIG. 1, and additional tension is created in the yarn 16 fed to that particular hook 21, then, hook 21 is retracted and the tensioned loop 35 is backdrawn or pulled off the pointed end 41 of the bill 27 to form a short uncut loop 44.

In order to assist in holding the long loops 35 upon the respective bills 27 and 28, a resilient finger, spring clip or looper clip 45 or 46, respectively, is mounted upon each corresponding hook 21 and 22. Each of the looper clips 45 and 36 may be identical, except in their lengths which correspond to the respective lengths of the bills 27 and 28.

Each clip 45 and 46 is preferably made of a unitary spring steel material, having a free end or clamp portion 48' and an intermediate or connecting portion 49 connecting the mounting portion 47 and the clamp portion 48'. The mounting portion 47 is disclosed as being in a substantially vertical attitude and fixed to the rear portion of the corresponding bill 27 or 28 by screws or rivets 50, or any other convenient type of fastener means. Extending beneath and across the bottom edge of each bill 27 and 28 is the connecting portion 49, the front portion of which merges with the creased clamping portion 48', biased into engagement against the needle side of the free end portion or pointed end portion 41 or 42 of the respective bill 27 or 28.

The intermediate portion 49 may join the mounting portion 47 in pre-formed crease 52, or it may be a continuous flat part of the mounting portion 47 which is biased across and beneath the bill 27 or 28 and held under tension by the clamping portion 48' engaging the free end portion 41 or 42 of the respective bill 27 or 28. In any event, the positioning of the intermediate portion 49 is such that it will not interfere with, or occupy the same space as, the knife 31 or 32 in any of its cutting positions relative to the corresponding hook 21 or 22.

In a hook, such as the hook 21, or 22, a notch 54 may be formed in a portion of the throat 25 or 26 in order to receive the portion of the intermediate portion 49 crossing beneath the corresponding bill 27 or 28. The notch 54 permits the intermediate or connecting portion 49 to cross over beneath the respective bill 27 or 28 without interfering with, or occupying the same space as, the knife 31 or 32 in its cutting path. Still, the knife, such as knife 31, is free to cooperate, not only with the bottom edge of the bill 27, but also with the throat, or forward edge of the throat, 25.

The thickness of each loop clip 45 and 46 is substantially less than the thickness of its corresponding hook 21 and 22, as illustrated in FIGS. 3 and 4. Thus, as illustrated in FIG. 3, the interconnecting or intermediate portion 49 normally lies in inoperative position, between the opposite planar sides of the corresponding hook 21 or 22. As illustrated in FIG. 3, only the thicknesses of the mounting portion 47 and the clamping portion 48' project laterally from opposite sides of the hook 21 or 22 in inoperative position.

Moreover, as illustrated in FIG. 4, the thinness of each clip, such as 45, permits the flared clamping portion 48 and the intermediate portion 49 to be moved laterally only slightly beyond the lateral extent of the needles 11, when engaged by the needle, thus not interfering with the knife 32 on the adjacent looper 22.

It will be particularly noted that the mounting portion 47 of each clip is located rearward of the corresponding throat 25, so that the connecting portion 49 may cross over beneath the corresponding bill 27 substantially behind the knife 31, in any of its cutting positions.

Otherwise, the looper clips 45 and 46 function in the same manner as they do in the prior Card U.S. Pat. No. 3,084,645, insofar as the holding of the long loops 35 upon the respective bills to permit cutting thereof, and yielding against the tension of the backdrawn yarns in order to create the short uncut pile loops 44.

However, only the looper clips 45 and 46 are adapted to operate successfully where the needle gauges are as small as $\frac{1}{8}$ of an inch, a gauge in which looper apparatus such as those disclosed in the prior Card U.S. Pat. No. 3,084,645 could not successfully function.

It will be understood that the clamping portions 48' of the respective spring clips 45 and 46 may be constructed in a similar manner to the clamping portions of the spring clips in the prior Card U.S. Pat. No. 3,084,645. That is, the clamping portion 48' may have a vertical crease therein, with its free end portion flaring laterally away from the corresponding pointed end of the bill 27 or 28, in order to guide the respective needle 11 or 12 between the respective spring clip 45 or 46 and its corresponding bill 27 or 28, as disclosed in FIG. 4. However, in the preferred form of the clip 46, as disclosed in the drawings, the lower triangular flared portion 48 flares outward along a diagonal crease from the flat-faced clamping portion 48' to guide the needle 11 or 12 between the clip 46 and the corresponding bill 27 or 28.

After the needles 11 and 12 have moved upward above their respective spring clips 45 and 46, the clamping portion 48' will immediately spring back into engagement with the corresponding pointed ends 41 and 42 to prevent any loops formed upon the respective bills 27 and 28 from being pulled off the respective hook 21 or 22, unless the yarn in that particular loop is backdrawn because of the slow or starved feeding of the pattern control yarn feed apparatus 40.

The elasticity of each of the spring clips 45 and 46 is such that the backdrawn yarn will force the clamping portion 48' away from the hook bill to release the tensioned loop 44.

As best illustrated in FIG. 4, the needle side of the hook 21 has been relieved at 56 to provide a bill 27 and 28 of substantially less width than the remaining portion of the hooks 21 and 22. The thinner bills 27 and 28 will permit a more narrow needle gauge particularly when used in conjunction with the loop clips 45 and 46, since these clips have their mounting portions 47 on the opposite or cutting side of the respective hooks 21 and 22. Thus, when each needle 11 and 12 slides in between respective bills 27 and 28 and respective clips 45 and 46, the clips 45 and 46 will not be thrust as far away from their respective bills 27 and 28 as they would from a hook having a uniform thickness throughout.

Although this invention has been described in conjunction with a staggered needle cut pile tufting machine, it could be, and has been, incorporated in a tufting machine having a single transverse row of "in-line" needles. The cut pile hooks, having bills of equal length, and the clips, also of equal length, are in transverse alignment for cooperation with the "in-line" needles. Such an arrangement has been successfully used in a $\frac{1}{8}$ inch gauge in "in-line" tufting machine. Of course, finger gauges can be obtained when the needles are staggered, and looper apparatus 20 is employed.

What is claimed is:

1. In a tufting machine having means for supporting the base fabric for longitudinal movement in the feeding direction through said machine, a plurality of transversely spaced reciprocal needles for introducing yarns through the base fabric to form loops, means for selectively controlling the length of a yarn fed to each of said needles, looper apparatus comprising;

(a) a hook for each needle cooperating with said corresponding needle to form a loop thereon, each hook having a cutting side and an opposite needle side, (b) each of said hooks having a shank and a bill projecting longitudinally from said shank and terminating in a free end portion, (c) reciprocal hook bar means supporting said hooks transversely spaced apart with said free end portions extending in the direction opposite said feeding direction, (d) a knife for each hook, (e) knife supporting means supporting said knives transversely so that each knife cooperates with the cutting side of the bill of a corresponding hook for cutting a loop on said bill, (f) a looper clip having a mounting portion, a clamping portion and a connecting portion connecting said mounting portion to said clamping portion, (g) means securing said mounting portion in fixed relationship to the cutting side of said corresponding hook to normally bias said clamping portion against the needle side of the free end portion of said bill to normally hold loops formed on said bill, but yieldable to predetermined yarn tension in a loop on said bill to force said clamping portion away from said bill to permit tensioned loop to be withdrawn from the free end of said hook to form an uncut loop, and (h) all portions of said clip occupying a space which will not interfere with the cutting of a loop on said corresponding hook by said knife.

2. The invention according to claim 1 in which each of said bills has a top edge and a bottom edge, said connecting portion of said looper clip being spaced below the bottom edge of said corresponding bill and away from the cutting path of said corresponding knife.

3. The invention according to claim 1 in which said mounting portion is fixed to the cutting side of said shank.

4. The invention according to claim 3 in which said shank has a front edge and said corresponding knife cooperates with said front edge and the bottom edge of said bill to cut loops on said corresponding hook, a recess in a portion of said shank to receive a part of the connecting portion of said clip extending beneath the bottom edge of said bill.

5. A looper apparatus for a tufting machine comprising:

(a) a hook comprising a shank having a mounting portion adapted to be mounted on the hook bar of a tufting machine, and a bill projecting from said shank and terminating in a free end portion, (b) said bill having a cutting side and an opposite needle side and a top edge and a bottom edge converging into said free end portion, (c) said bill comprising a cutting zone on the cutting side of said hook adapted to cooperate with a knife in said tufting machine to cut tufted loops on said bill, (d) a spring clip having a body portion and a clamp portion, (e) means mounting said body portion upon the cutting side of said hook to normally bias said clamp portion against the needle side of the free end portion of said bill, said body portion extending beneath the bottom edge of said bill from said cutting side to said needle side, so that no portion of said clip occupies said cutting zone.

6. The invention according to claim 5 in which said spring clip is generally arch-shaped, concave upward, said body portion including a clip mounting portion fixed to the cutting side of said shank and a lower connecting portion connecting said clip mounting portion to said clamp portion, said connecting portion being spaced below the bottom edge of said bill, and said clamp portion projecting upward into biased engagement against the needle side of the free end portion of said bill.

7. The invention according to claim 5 in which the opposite sides of said hook are planar, the thickness of said spring clip is substantially less than the thickness of said hook shank, and the connecting portion of said spring clip is substantially wholly contained between the planes of the cutting side and the needle side of said hook.

8. The invention according to claim 6 in which said clamp portion has an upper clamp face and a lower flared portion, said upper clamp face being normally biased into flush engagement with the needle side of the free end portion of said bill, and said lower flared portion diverging away from said bill to engage the needle cooperating with said corresponding hook.

* * * * *